US005996561A

United States Patent [19]

Watanabe

[11] Patent Number: 5,996,561

[45] Date of Patent: Dec. 7, 1999

[54] VAPOR SEPARATOR FOR OUTBOARD MOTOR

[75] Inventor: Takahide Watanabe, Hamamatsu, Japan

[73] Assignee: Sanshin Kogyo Kabushiki Kaisha, Hamamatsu, Japan

[21] Appl. No.: 08/999,412

[22] Filed: Dec. 23, 1997

[30] Foreign Application Priority Data

Dec. 25, 1996 [JP] Japan ..... 8-345457

[51] Int. Cl.[6] ..... F01M 1/10; B63H 20/00

[52] U.S. Cl. ..... 123/572

[58] Field of Search ..... 123/572, 573, 123/574

[56] References Cited

U.S. PATENT DOCUMENTS

| | | | |
|---|---|---|---|
| 5,383,440 | 1/1995 | Koishikawa et al. | 123/572 |
| 5,488,939 | 2/1996 | Nakai et al. | 123/572 |
| 5,501,202 | 3/1996 | Watanabe | 123/572 |
| 5,555,858 | 9/1996 | Katoh | 123/572 |
| 5,794,602 | 8/1998 | Kimura | 123/572 |

*Primary Examiner*—Marguerite McMahon
*Attorney, Agent, or Firm*—Knobbe, Martens, Olson & Bear LLP

[57] ABSTRACT

A vapor separator for an outboard motor is disclosed. The outboard motor has a cowling and a water propulsion device. An internal combustion engine is positioned in the cowling and arranged to propel the water propulsion device. The engine includes a top and a bottom side. The engine also includes an engine block defining at least one cylinder bore therein. A crankshaft is supported for rotation with respect to the engine block and is located in a first chamber. A camshaft is supported for rotation with respect to the engine block and is located in a second chamber. The engine further includes a lubrication system for the lubrication of the crankshaft and the camshaft. A lubrication collection area is located on the bottom side of the engine for the gravitational collection of engine lubrication fluid from the first chamber and the second chamber. A breather chamber is located on the top side of the engine first passage providing fluid communication between the lubrication collection area and the breather chamber and a second passage in communication between the second chamber and the first passage wherein the second passage is substantially oblique to the first passage.

10 Claims, 11 Drawing Sheets

VAPOR SEPARATOR FOR OUTBOARD MOTOR

FIELD OF THE INVENTION

This invention relates to an improved method of recovering blow-by gas from the compression stage of the combustion process. In particular, the invention relates to an improved arrangement and location of a breather element for an internal combustion engine.

BACKGROUND OF THE INVENTION

Watercraft are often powered by an outboard motor positioned at a stern of the craft. The outboard motor has a powerhead and a water propulsion device, such as a propeller. The powerhead includes a cowling in which is positioned an internal combustion engine, the engine having an output shaft arranged to drive the water propulsion device.

Generally, the motor is connected to the watercraft in a manner which permits the motor to be "trimmed" up and down. For example, the motor may be connected through a horizontally extending pivot pin to a clamping bracket which attaches to the watercraft. In this manner, the motor may be moved in a vertical plane about the axis of the pin. This allows an operator of the watercraft to raise the propeller out of the water of place it deep in the water dependent upon the trim angle of the motor.

In addition, the motor is arranged to turn left and right about a generally vertically extending axis. This arrangement permits the operator of the watercraft to change the propulsion direction of the motor, and thus change the direction in which the watercraft is propelled.

The size of the motor, especially the powerhead portion which includes the motor, effects the air drag associated with the watercraft. It is desirable for the motor to have a small profile to reduce the air drag. In addition, it is generally desirable for the engine to be compact, since this makes the task of trimming and turning the motor less difficult.

The engine typically is of the internal combustion type with one or a plurality of cylinders. Internal combustion engines typically incorporate reciprocating piston in the cylinders. The engines typically operate on the two or four stroke principal. In either of the two or four stroke cycle there is a compression stage where the piston is compressing the fuel and air mixture within the cylinder before the ignition system is triggered. During this compression stroke some of the fuel and air mixture passes or "blows" by the piston seal ring and then travels to the crankcase chamber. A portion of the fuel and air mixture also blows-by the valve seat and into the chamber surrounding the camshafts.

As the engine operates, more of the fuel and air mixture builds and accumulates in crankcase and the area surrounding the camshaft. In order to increase the efficiency of the engine as well as decrease the emissions of the motor is it desirable to capture the blow-by gas and route it back to in the intake system of the motor.

A need therefore exists to increase the efficiency of the engine. Further, a need exists to improve the emissions of the engine.

Once the blow-by gas is in the crankcase chamber and the area surrounding the cam shaft it is exposed to the engine oil. Once exposed to the engine oil, the fuel and air mixture combines with the engine oil. Allowing the mixture of engine oil and the fuel and air mixture back into the combustion chamber is undesirable as it will decrease the engine performance as well as increase the emission output.

A need therefore exists for a blow-by gas arrangement that separates the fuel and air mixture from the engine oil.

One solution for this problem is shown in FIG. 14. In FIG. 14 a schematic engine is shown with an engine 26, including crankcase chamber 418 and a camshaft chamber 400 with a blow-by gas passage 404 therebetween. The engine 26 also includes an oil pan 412 to capture the engine oil before it is returned to the galleries where it is used to lubricate the crankshaft and camshaft. Further, the engine contains a breather element 432 to separate the engine oil from the blow-by fuel and air mixture. In this design, the breather element 432 is adjacent to the cam chamber 400 so as too minimize the overall height of the engine to minimize air drag. A problem with this design, however, is that too much of the engine oil is put into the breather element. Therefore, engine oil is being sent into the combustion chamber thereby decreasing engine performance. Furthermore, the engine oil is burning in the combustion process and is increasing the emissions thereby creating smoke and an undesirable smell.

A need therefore exists to improve the arrangement of the components of the engine in order to maintain increase engine performance as well as improve engine exhaust emissions.

SUMMARY OF THE INVENTION

The present invention is an engine arrangement for an engine powering an outboard motor. Preferably, the motor is of the type which has a water propulsion device and a cowling. The engine is of the internal combustion type, is positioned in the cowling and has a crankshaft arranged to drive the water propulsion device of the motor.

The engine includes an engine block defining at least one cylinder bore therein. A crankshaft is supported for rotation with respect to the engine block and located in a first chamber. A camshaft is supported for rotation with respect to the engine block and is located in a second chamber. A lubrication system is also provided for the lubrication of the crankshaft and the camshaft.

A lubrication collection area is located on the bottom side of the engine for the gravitational collection of engine lubrication fluid from the first chamber and the second chamber. A breather chamber located on the top side of the engine. A first passage provides fluid communication between the lubrication collection area and the breather chamber and a second passage in communication between the second chamber and the first passage wherein the second passage is substantially oblique to the first passage.

The first passage further includes a third passage for fluid communication in a third direction between the breather chamber and a fourth passage. The fourth passage is substantially parallel to the third passage. The fourth passage is in fluid communication in a fourth direction with the second passage and a fifth passage providing fluid communication in a fifth direction with the first chamber.

Further objects, features, and advantages of the present invention over the prior art will become apparent from the detailed description of the drawings which follows, when considered with the attached figures.

DETAILED DESCRIPTION OF THE PREFERRED EMBODIMENTS OF THE INVENTION

The present invention is a blow-by gas recirculation arrangement for an engine of the type utilized to power a water propulsion device of an outboard motor and positioned in a cowling of the motor. The engine arranged in accordance with the present invention is described for use with an outboard motor since this is an application for which the engine as arranged has particular utility. Those of skill in the art will appreciate that an engine as arranged in accordance with the present invention may be used in a variety of other applications.

Figure 1:
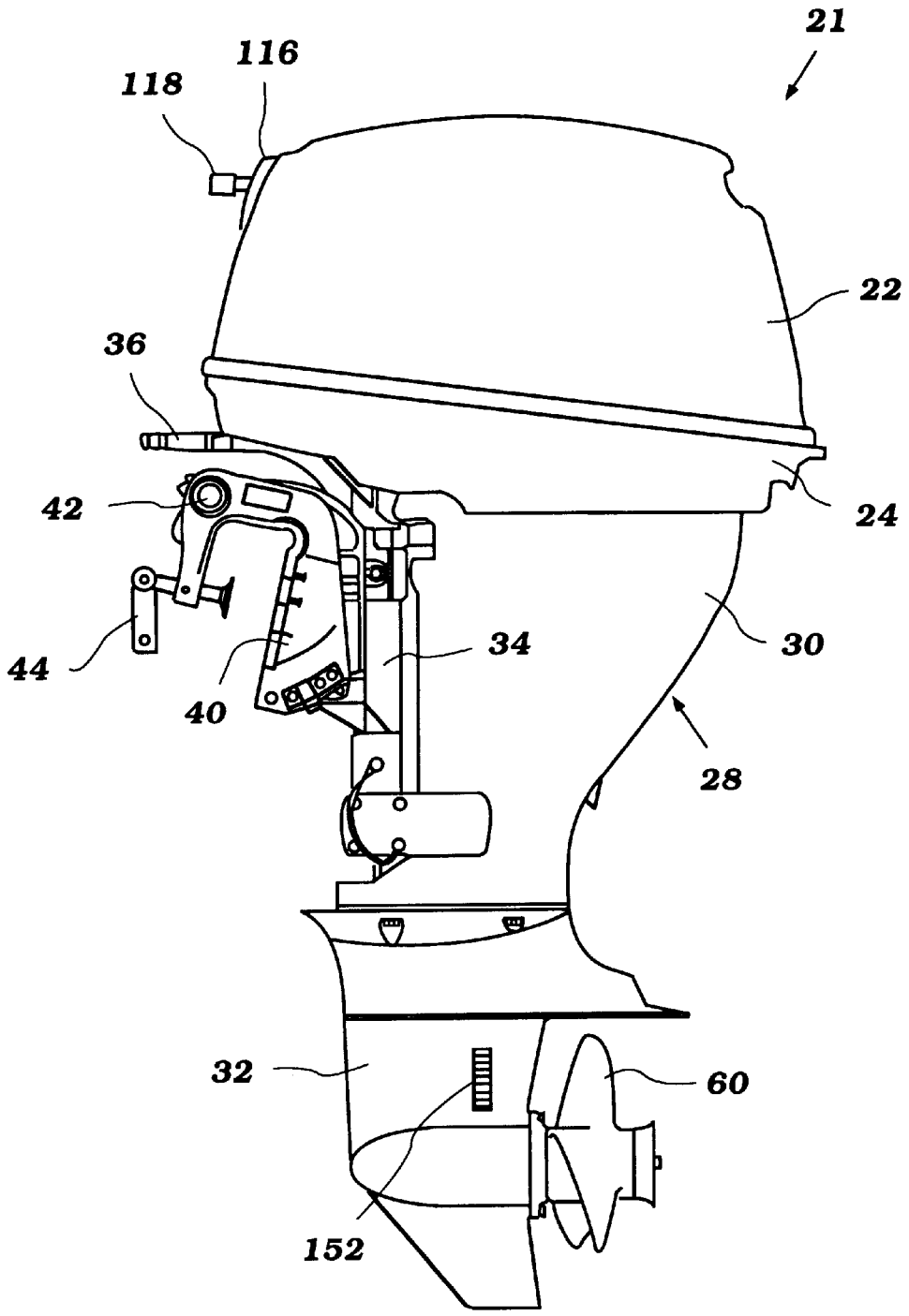
FIG. 1 is a side view of an outboard motor of the type utilized to propel a watercraft, the motor powered by an engine arranged in accordance with the present invention.
Figure 2:
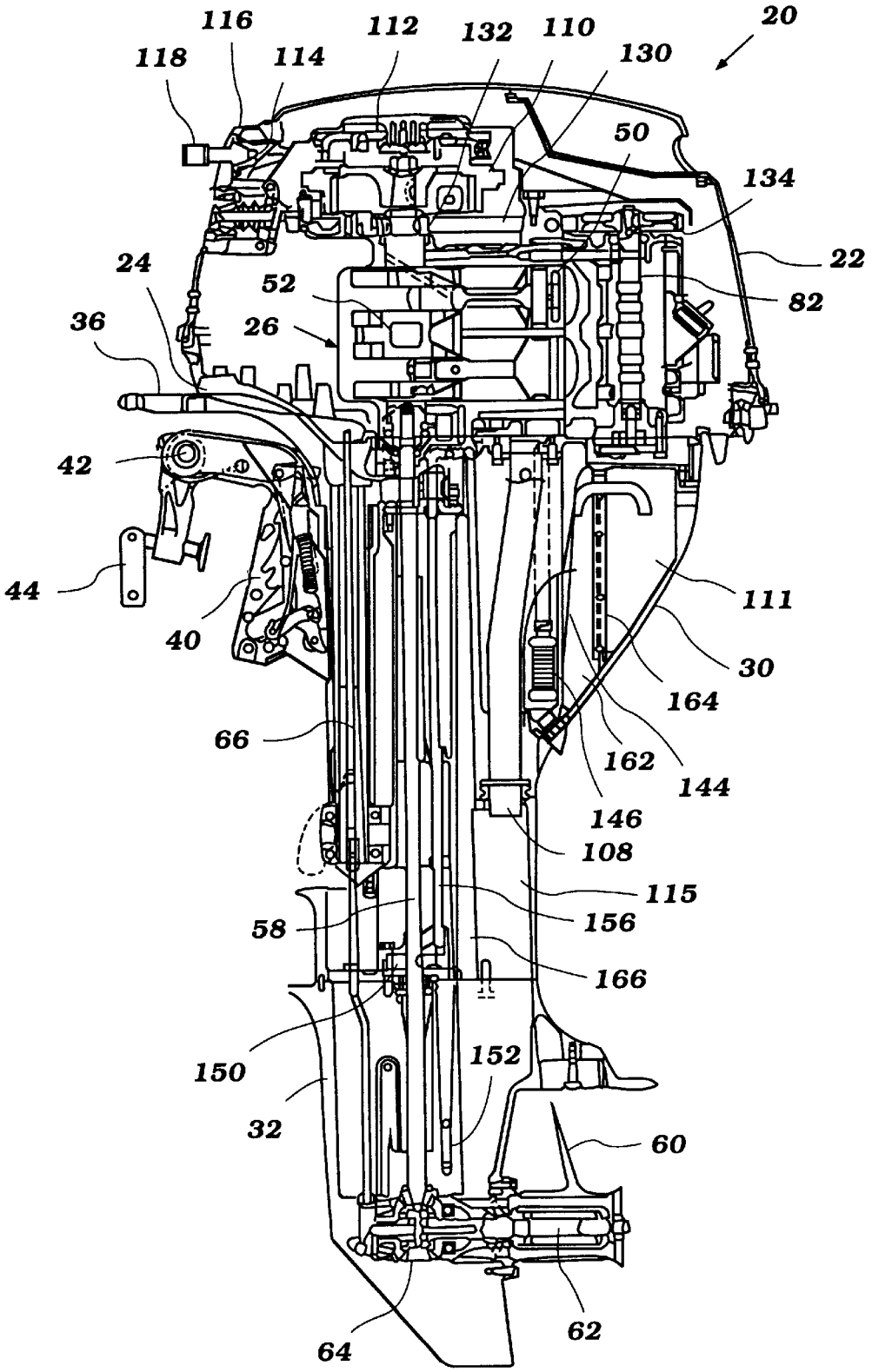
FIG. 2 is a cross-sectional side view of the motor illustrated in FIG. 1.

FIG. 1 illustrates an outboard motor 20 of the type with which the present invention is useful. The outboard motor 20 has a powerhead comprising a main cowling 22 with a lower cowling or tray 24 positioned therebelow. As illustrated in FIG. 2 and described in more detail below, an internal combustion engine 26 is positioned in the powerhead.

A drive shaft housing or lower unit 28 depends below the powerhead. The drive shaft housing 28 comprises an upper casing 30 and a lower unit 32 positioned below the upper casing.

The outboard motor 20 is arranged to be movably connected to a hull of a watercraft (not shown), preferably at a transom portion of the watercraft at a stem thereof. In this regard, a steering shaft (not shown) is connected to the drive shaft housing 28 portion of the motor 20. The steering shaft preferably extends along a vertically extending axis through a swivel bracket 34. The mounting of the steering shaft with respect to the swivel bracket 34 permits rotation of the motor 20 about the vertical axis through the bracket 34, so that the motor may be turned from side to side.

A steering handle or tiller 36 is connected to the bracket 34. An operator of the motor 20 may move the outboard motor 20 from side to side with the tiller 36, thus steering the watercraft to which the motor is connected.

The swivel bracket 34 is connected to a clamping bracket 40 by means of a pivot pin 42 which extends along a generally horizontal axis. The clamping bracket 40 is arranged to be removably connected to the hull of a watercraft with a clamping screw 44 or similar mechanism. The mounting of the motor 20 with respect to the clamping bracket 40 about the pin 42 permits the motor 20 to be raised up and down or "trimmed."

As described above, an engine 26 is positioned in the powerhead. The engine 26 is preferably of the two-cylinder variety, arranged in in-line fashion and operating on a four-cycle principle. As may be appreciated by those skilled in the art, the engine 26 may have a greater or lesser number of cylinders, may be arranged in other than in-line fashion and may operate on other operating principles, such as a two-cycle principle.

Figure 4:
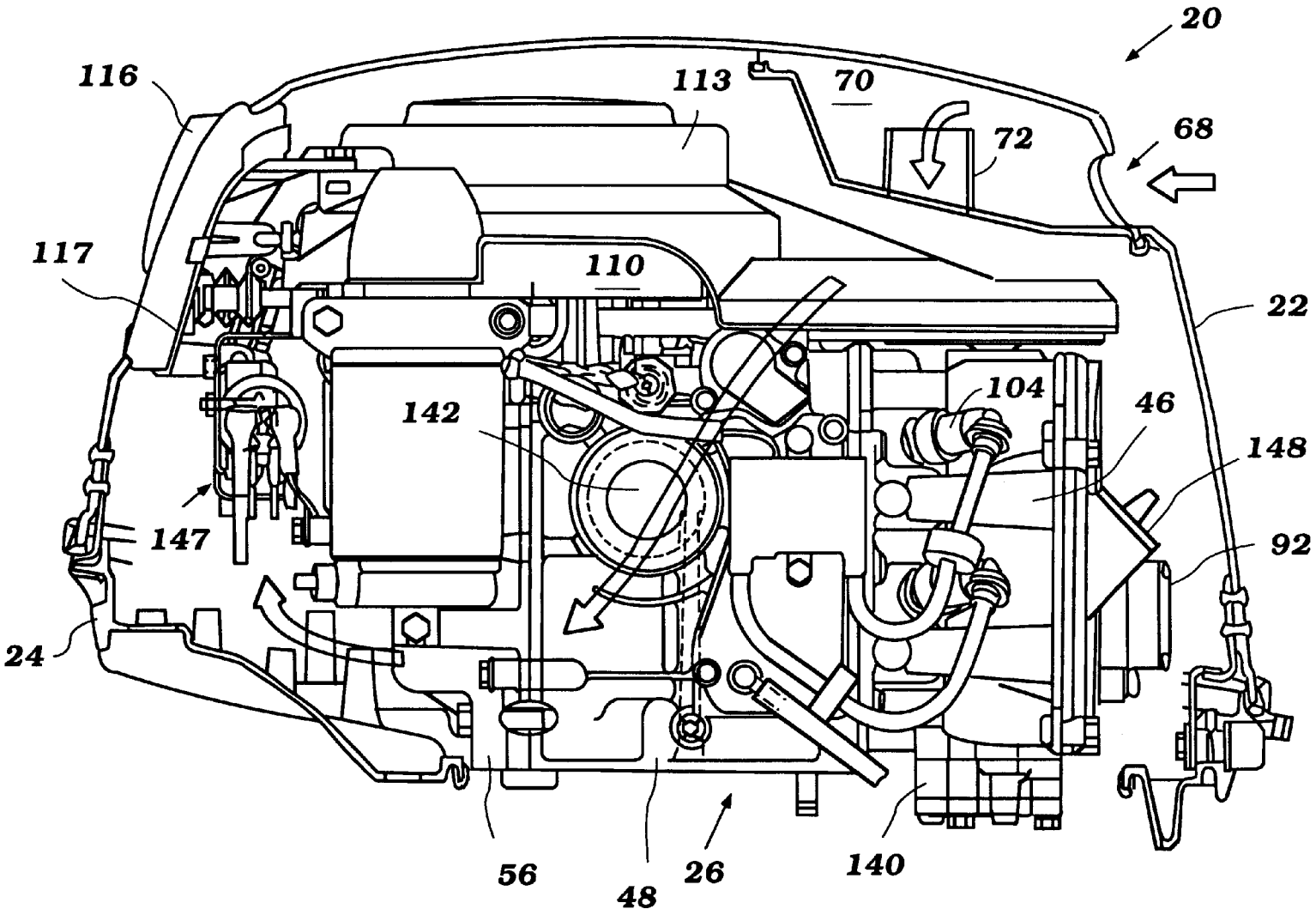
FIG. 4 is an enlarged cross-sectional view of a first side of a top portion of the motor illustrated in FIG. 1.

Referring to FIGS. 2 and 4, the engine 26 preferably comprises a cylinder head 46 connected to a cylinder block 48 and cooperating therewith to define two cylinders. A piston 50 is movably positioned in each cylinder 49 and connected to a crankshaft 52 via a connecting rod 54.

As best illustrated in FIG. 2, the crankshaft 52 is generally vertically extending. As such, the cylinders, and thus the pistons 48, extend in a horizontal direction. The crankshaft 52 is mounted for rotation with respect to the remainder of the engine 26 within a crankcase chamber defined by the cylinder block 48 and a crankcase cover 56 connected thereto. As illustrated, the crankcase cover 56 is positioned at the opposite end of the cylinder block 48 from the cylinder head 46. Preferably, the cylinder head end of the engine 26 is positioned within the main cowling 22 farthest from a watercraft when the motor 20 is attached thereto, and the crankcase end of the engine 26 is thus closest to a watercraft when the motor 20 is attached thereto.

The crankshaft 52 extends below a bottom of the engine 26 in the direction of the drive shaft housing 28, where it is coupled to a drive shaft 58. The drive shaft 58 extends through the drive shaft housing 28 and is arranged to drive a water propulsion device of the motor 20. As illustrated, the water propulsion device is a propeller 60.

In the preferred arrangement, the drive shaft 58 is arranged to selectively drive a propeller shaft 62 through a forward-neutral-reverse transmission 64. The propeller 60 is connected to an end of the propeller shaft 62 opposite the transmission 64. Preferably, the position of the transmission 64 is controlled by a shift rod 66 extending through the drive shaft housing 28 to the transmission 64 from a transmission, control (not shown) which the operator of the motor 20 manipulates.

An intake system provides air to each cylinder of the engine 26 for the combustion process. As illustrated in FIG. 4, air is drawn through a vent 68 in the main cowling 24 into an inlet area 70 formed by the main cowling 24. Air then flows through an upwardly extending air inlet pipe 72 into the interior of the cowling in which the engine 26 is positioned. The above-described arrangement serves to reduce the flow of water and the like through the vent 68 into the portion of the cowling 22 which houses the engine 26. In the preferred embodiment, a similar intake pipe 73 leads from the inlet area 70 into the engine compartment on the opposite side of the cowling 22 (see FIG. 3).

Figure 3:
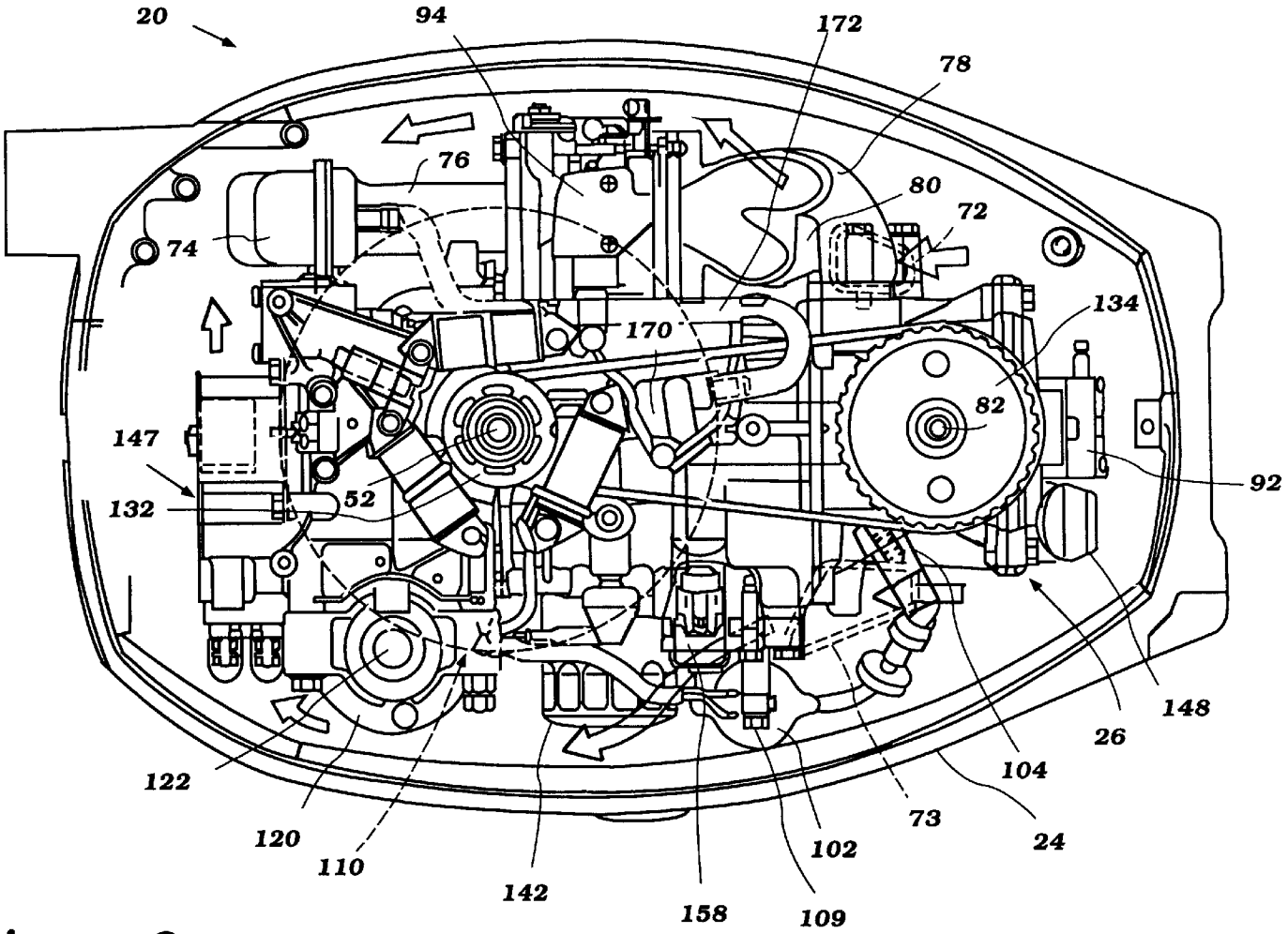
FIG. 3 is a top view of the motor illustrated in FIG. 1 with a main cowling and a flywheel cover removed, exposing a top end of the engine.
Figure 5:
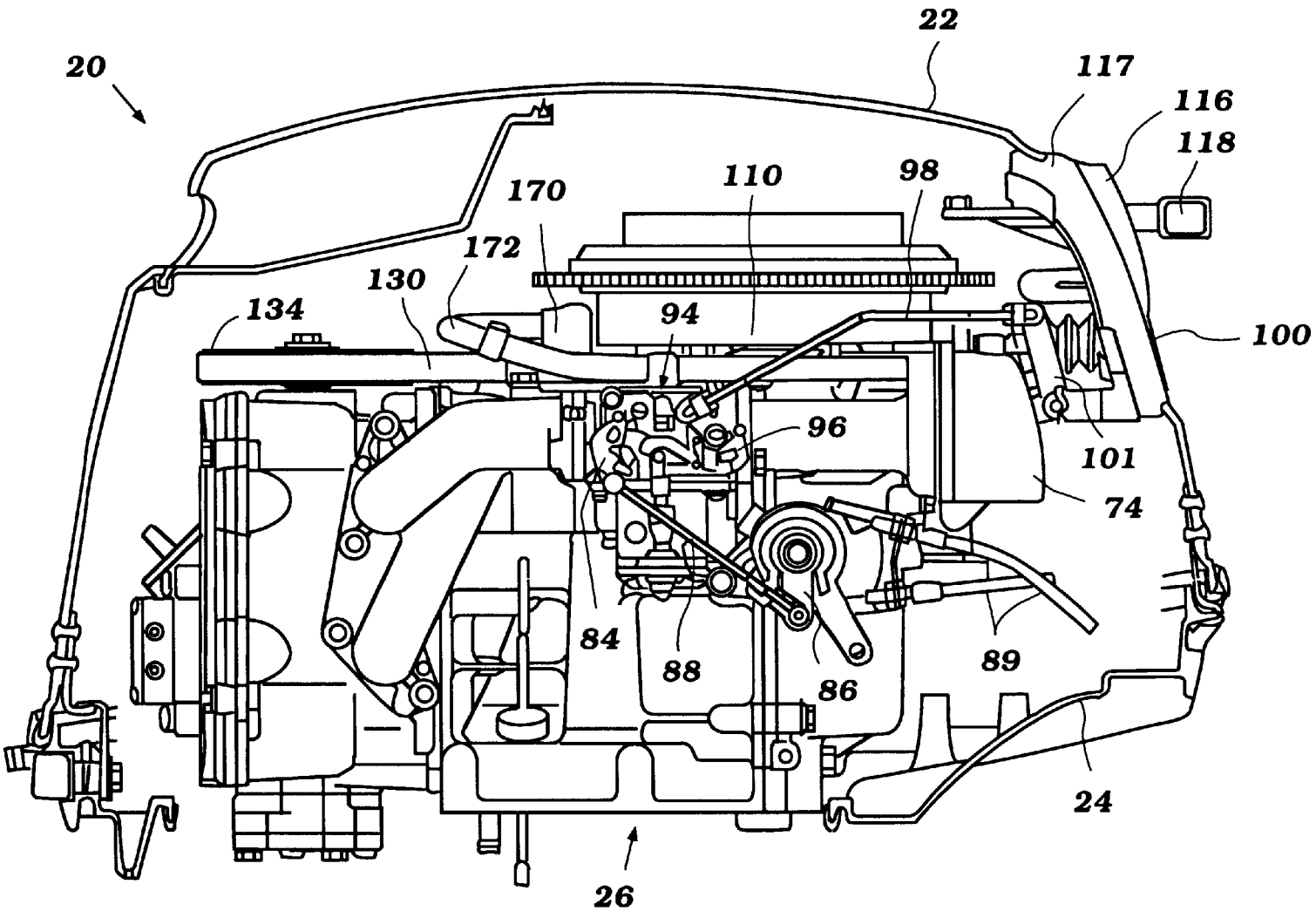
FIG. 5 is an enlarged cross-sectional view of a second side of a top portion of the motor illustrated in FIG. 1 with a portion of the cover of the engine removed.
Figure 7:
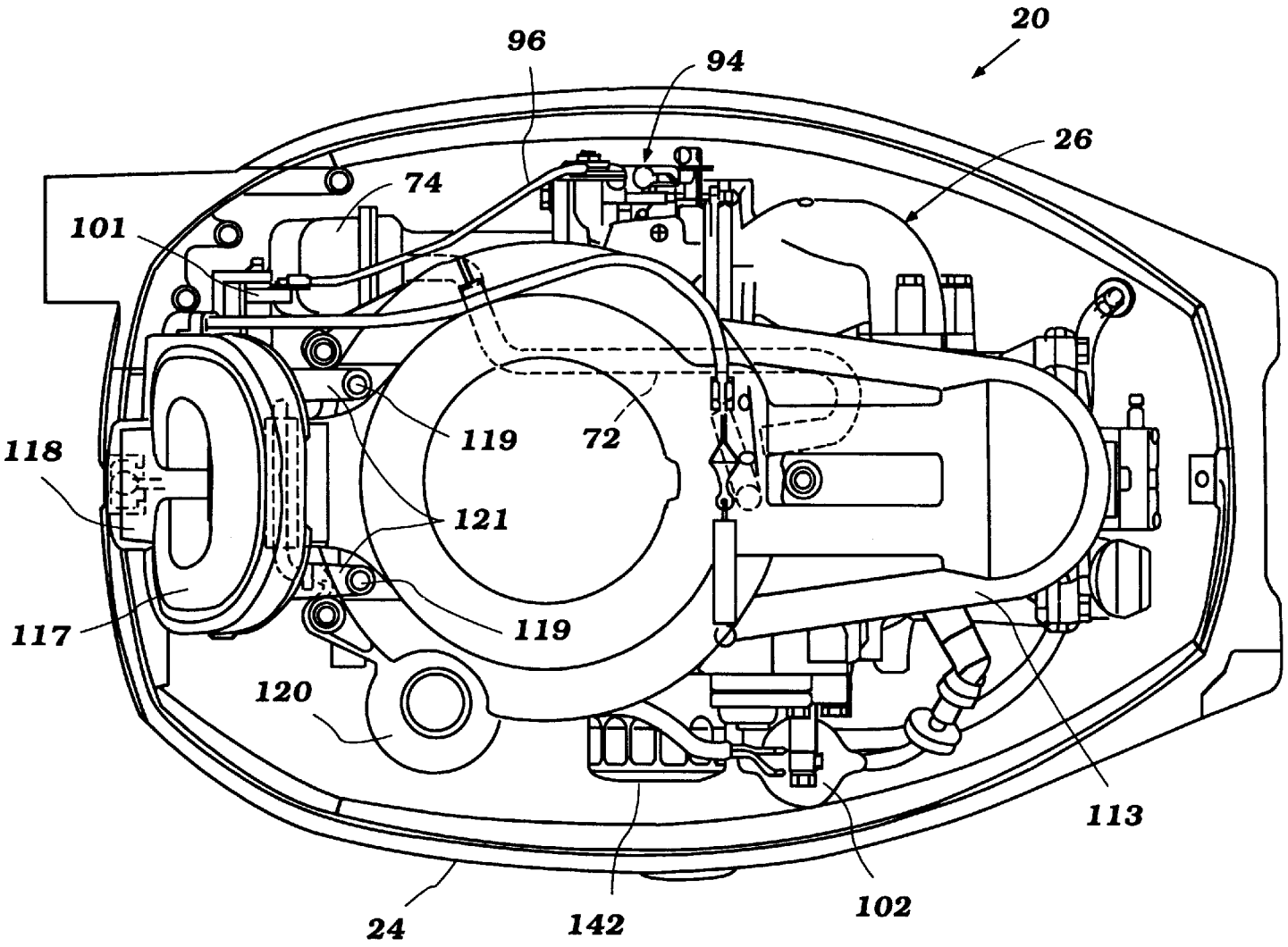
FIG. 7 is a top view of the motor illustrated in FIG. 1, with a portion of a main cowling removed, exposing the engine therein.

Referring now to FIGS. 3, 5 and 7, air within the main cowling 22 is drawn into a silencer 74. The air is then drawn from the silencer 74 through an intake pipe 76 to a pair of branch pipes 78, 80. The branch pipes 78, 80 are connected to the cylinder head 46 of the engine 26 and each have a passage therethrough aligned with a corresponding passage through the cylinder head 46 leading to one of the cylinders. In this manner, air flows through the intake pipe 76 and respective branch pipes 78,80 to each cylinder.

In the embodiment illustrated, the intake pipe 76 and branch pipes 78,80 preferably extend along a first side of the engine 26 from the crankcase chamber end towards the cylinder head end, generally below a top of the engine.

Preferably, means are provided for controlling the flow of air into each cylinder in a timed manner. This means may comprise an intake valve 81 positioned in each intake passage leading through the cylinder head 46 to a cylinder. In such an arrangement, each intake valve is preferably actuated between open and closed positions, as known to those of skill in the art, by at least one camshaft 82 by means of a rocker arm 83 (see FIG. 10).

Means are also provided for controlling the rate of air flow through the intake system to each cylinder. Preferably, this means comprises a throttle valve (not shown) positioned in the intake pipe 76. Referring to FIG. 5, the throttle valve is preferably actuated by a throttle lever 84. This lever 84 is connected to a pivot lever 86 via a throttle link 88. A throttle actuator wire 89 is connected to the pivot lever 86 for moving the pivot lever 86, the wire 89 extending to an operator-engaged throttle control (not shown) as known to those skilled in the art.

A fuel system provides fuel to each cylinder for combustion with the air. The fuel system draws fuel from a fuel supply (not shown) such as a fuel tank positioned in the hull of the watercraft to which the motor 20 is connected. Preferably, as illustrated in FIG. 4, the fuel is drawn by a fuel pump 92. The fuel pump 92 delivers the fuel through a fuel line to a charge former. In the preferred embodiment, the charge former comprises a carburetor 94.

As illustrated, the carburetor 94 is positioned along the intake pipe 76 for introducing fuel into the air passing therethrough. In this manner, a combined air and fuel charge is delivered through the branch pipes 78,80 to the cylinders. Though not described herein, those of skill in the art will appreciate that other charge formers such as fuel injectors may be used. In addition, a carburetor may be provided corresponding to an intake pipe leading to each cylinder instead of a single carburetor for all cylinders as in the illustrated embodiment.

The carburetor 94 is preferably arranged so that the movement of the throttle lever 84 effectuates a change in the rate of air and fuel delivery, as is known to those of skill in the art. A choke lever 96 is also associated with the carburetor 94 and controls the position of a choke valve (not shown) which is movably positioned in the intake pipe 76. The choke lever 96 is actuated through a choke link 98 from a choke knob 100. Preferably, the knob 100 is positioned externally to the main cowling 22 at the end of the motor 20 which is closest the watercraft for engagement by an operator of the watercraft. More particularly, the knob 100 is mounted to the combination guide and mount 116 connected to the cowling 22.

Referring to FIG. 5, an offset linkage mechanism 101 is provided between a rod which is associated with the knob 100 and the link 98 for transmitting a force applied to the knob 100 to the link 98 for actuating the choke valve.

The engine 26 includes an ignition system. Such systems are well known to those of skill in the art, and thus the system is not described in detail herein. Preferably, however, the system includes a powered ignition coil 102 which delivers a charge at a predetermined time to a spark plug 104 corresponding to each cylinder as illustrated in FIG. 3. Each spark plug 104 has its tip positioned in the cylinder, and when the charge is delivered to the spark plug, effects a spark across an electrode tip thereof to initiate the combustion of the air and fuel mixture in the cylinder.

In the embodiment illustrated, the ignition coil 102 has a pair of mounting parts 103 extending from a housing thereof. The mounting parts 103 are connected to a pair of bosses 105 extending from a cover element 107. As described in more detail below, the cover element 107 defines a coolant passage 158 through which coolant flows for cooling a portion of an exhaust system. Preferably, a bolt 109 engages each mounting part 103 of the coil 102 and a corresponding boss 105.

Referring to FIGS. 2 and 3, an exhaust system is provided for routing exhaust from each cylinder. Preferably, an exhaust passage (not shown) leads through the cylinder head 46 from each cylinder. Each passage leads to a passage through an exhaust manifold 106 connected to the cylinder head 46. Preferably, the manifold 106 is arranged to route exhaust gases to an exhaust pipe 108 which extends below the engine 26 into the drive shaft housing 28. The exhaust pipe 108 terminates in a first expansion chamber or muffler 115. When the engine speed is low and the exhaust backpressure is low, the exhaust is preferably routed to a second expansion chamber 111 and then through an above the water exhaust gas discharge. When the engine speed is higher and the exhaust pressure is high, the exhaust is preferably routed from the expansion chamber 115 through a through-the-hub (of the propeller) discharge into the body of water in which the motor 20 is operating.

Figure 10:
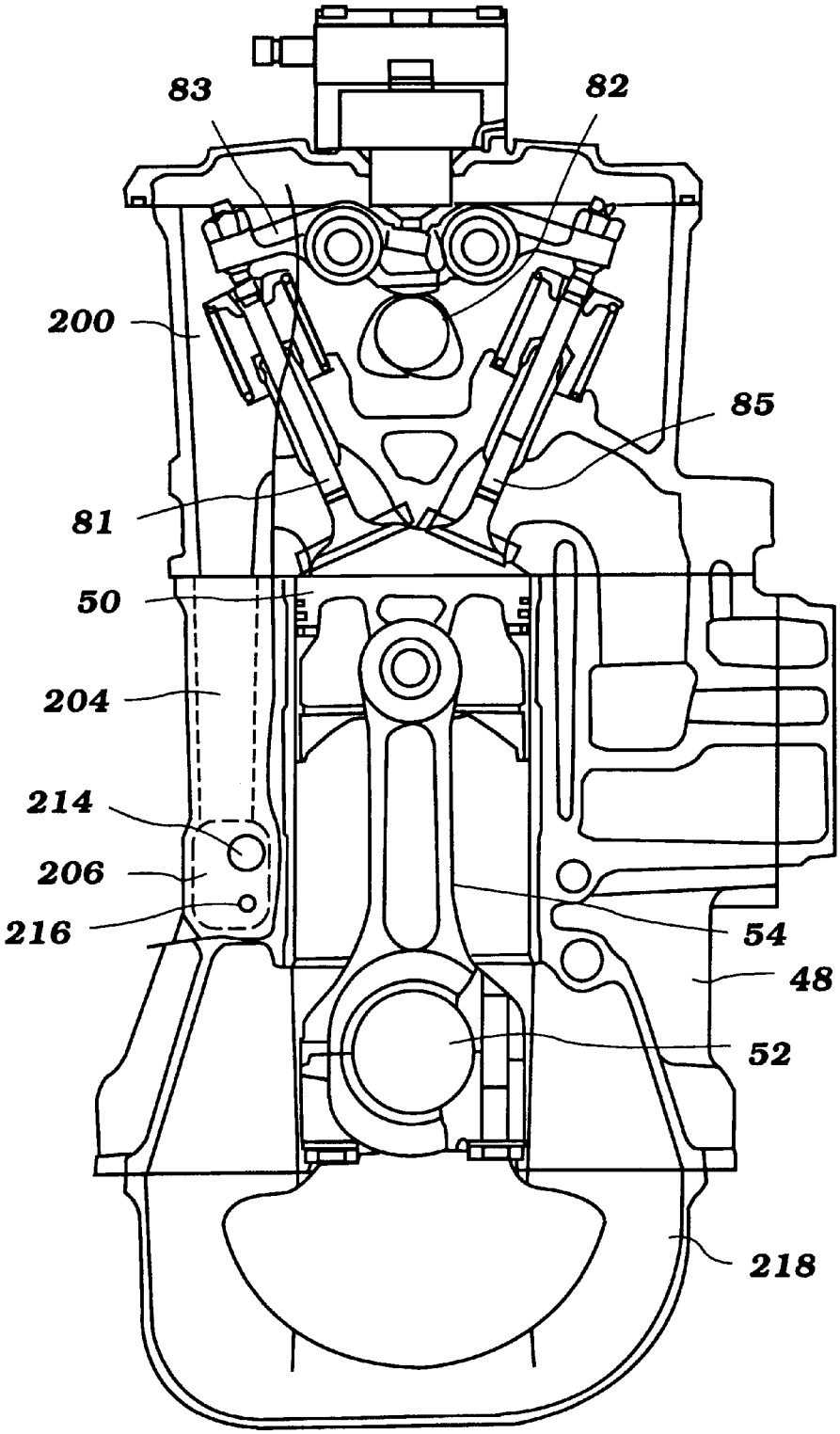
FIG. 10 is a cross sectional view of FIG. 9 taken generally along the line 10—10.

As with the intake system, valve 85 means are preferably provided corresponding to each cylinder for controlling the flow of exhaust therefrom. As illustrated in FIG. 10, these means may comprise an exhaust valve associated with each cylinder and movable between one position in which exhaust is permitted to flow through the exhaust passage therefrom, and a second position in which the exhaust is not permitted to flow from the cylinder. The same camshaft 82 which is used to control the intake valves may be used to control the exhaust valves. Alternatively, and as known to those of skill in the art, a separate exhaust camshaft may be provided for actuating only the exhaust valves.

A starter mechanism is provided for use in starting the engine 26. Referring to FIGS. 2 and 4, the starter mechanism preferably includes a recoil type starter. In this arrangement, the crankshaft 52 extends above a top end of the engine 26. A flywheel 110 is connected to the portion of the crankshaft 52 extending above the engine 26.

A recoil starter mechanism 112 of a type known to those of skill in the art is preferably associated with the flywheel 110. The recoil starter mechanism 112 is positioned above the flywheel 110, but under a starter mechanism/flywheel cover 113.

A starter cord 114 extends from the recoil mechanism through a combination cord guide and mounting 116 extends through the main cowling 22. A seal 117 is preferably provided between the cord guide 116 and the cowling 22 for providing an air and water tight seal therebetween.

A handle 118 is connected to the end of the cord 114 which extends through the guide 116. In this arrangement, when the operator of the watercraft pulls on the handle 118 and extends the cord 114, the flywheel 110 is rotated, starting the engine 26.

When this type of starting mechanism is employed, the ignition system preferably includes a magneto-type generator which generates power for powering the ignition coil 102 without the need for a battery.

As best illustrated in FIG. 7, the combination guide and mount 116 and recoil mechanism cover 113 are connected securely to one another through a pair of bolts 119. The bolts 119 extend through a pair of spaced flanges 121 extending from the guide 116 towards the cover 113, and into the cover 113 itself.

The motor 20 may also be provided with an electrically powered starter motor 120 for those instances where a battery is available. Referring to FIGS. 3 and 4, the starter motor 120 is preferably mounted along a side of the engine 26 with a pinion gear 122 arranged to drive the flywheel 110. A cover 124 is mounted over the pinion gear 122.

The motor 120 is preferably mounted to several mounting flanges or bosses 121 extending from the crankcase cover 56, as best illustrated in FIGS. 3 and 4. The motor 120 includes one or more corresponding mounting areas. In the embodiment illustrated, a bolt 123 engages each mounting area of the starter motor 120 and a corresponding boss 121. Of course, the starter motor 120 may be mounted in a variety of other manners as appreciated by those of skill in the art.

Figure 6:
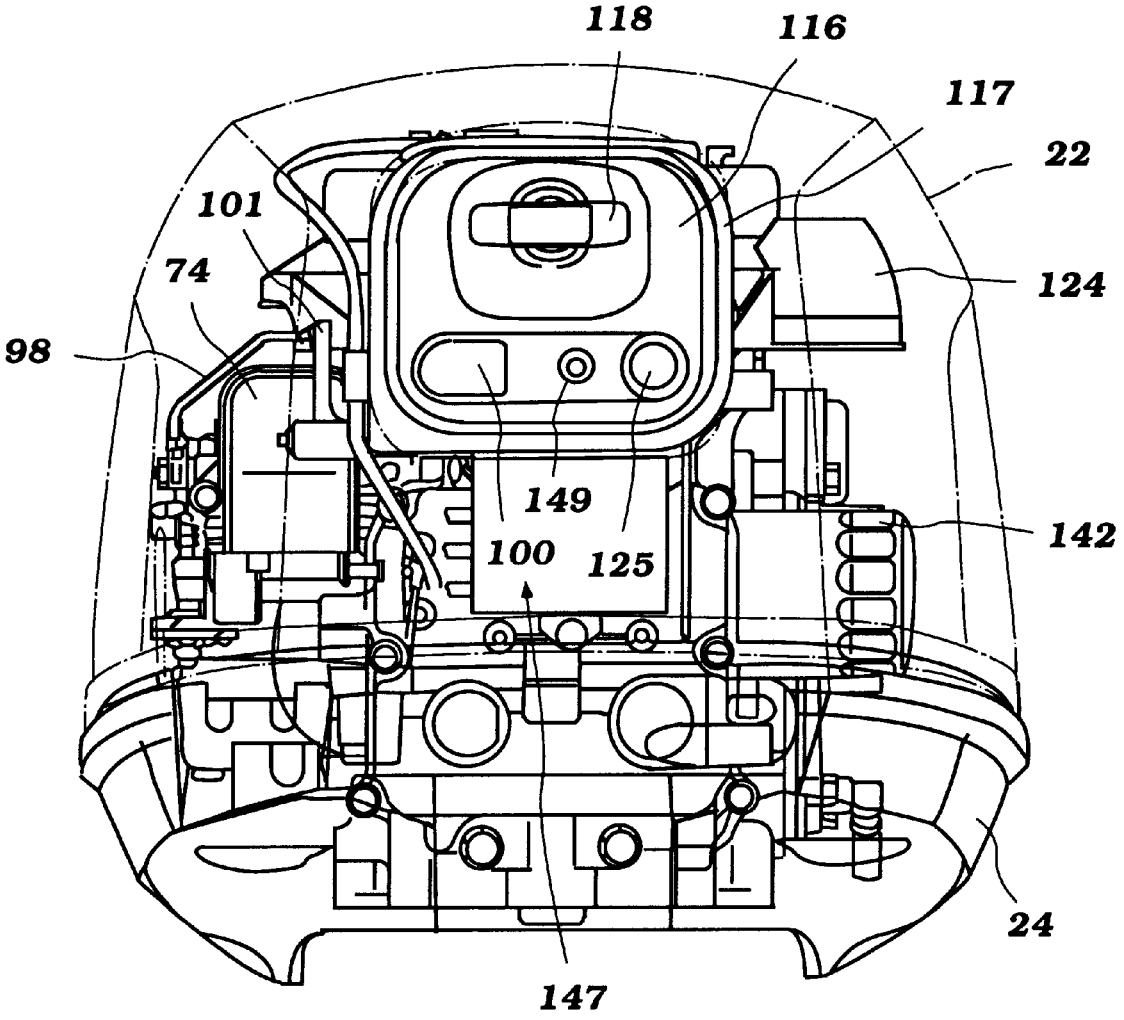
FIG. 6 is an end view of the engine powering the motor illustrated in FIG. 1, with a portion of the cowling enclosing the engine illustrated in phantom.

When an electric starter 120 is provided, a starter button 125 is preferably mounted to the mount 116 on the exterior of the main cowling 22, near the choke button 100 as illustrated in FIG. 6.

Means are provided for driving the camshaft 82. As illustrated in FIG. 2, the camshaft 82 is preferably driven by the crankshaft 52 by means of a flexible transmitter such as a chain or belt 130. A drive pulley 132 is connected to the portion of the crankshaft 52 which extends above the top end of the engine 26. Preferably, the drive pulley 132 is mounted below the flywheel 110. A driven pulley 134 is connected to an end of the camshaft 82 also extending above the top end of the engine. The drive belt 130 extends in engagement with the two pulleys 132,134, whereby rotation of the crankshaft 52 effectuates rotation of the camshaft 82.

The motor 20 includes a number of sub-systems relating to the engine 26. First, a lubricating system provides lubricant to one or more parts of the engine 26 for lubricating them. The lubricating system includes means for drawing lubricant from a lubricant supply and delivering it to the engine 26. In the embodiment illustrated, the supply is located in an oil pan 144 positioned below the engine 26 in the drive shaft housing 28.

Preferably, the means for delivering lubricant comprises an oil pump 140. Referring to FIGS. 4 and 5, the lubricant pump 140 is positioned below the engine 26 and is preferably driven by an end of the camshaft 82 extending below the engine. The pump 140 draws lubricant upwardly towards the engine 26 through a filtered inlet 146 positioned in the oil pan 144.

The pump 140 delivers lubricant from the supply through a filter 142. The lubricant then flows through one or more passages or galleries through the engine 26 for lubricating the various parts thereof, as well known to those of skill in the art. The lubricant preferably drains downwardly through one or more drain passages to the lubricant or oil pan 144 for re-delivery to the engine.

Referring to FIG. 3, an oil fill port 148 is preferably provided at the end of the engine 26 where the cylinder head 46 is positioned. The oil fill portion 148 is provided in communication with the oil pan 144 through the drain lines, whereby an operator of the motor 20 may add lubricant to the lubricating system.

The lubricating system includes means for providing a warning of a lubricant system malfunction or undesirable condition. Referring to FIG. 6, a lubricant system warning lamp 149 is preferably provided on the mounting part 117 adjacent the choke knob 100. The lamp 149 may be arranged to illuminate when a lubricant sensor indicates that the lubricant level in the pan 144 is low, or the lubricant pressure in the lubricant system is too low or too high, or when other similar undesirable lubricating system conditions arise as known to those of skill in the art.

This warning system may include electronics 147 which are mounted at the crankcase end of the engine 26 adjacent the starter motor 120 as illustrated in FIG. 4. These electronics 147 may also include other electrical system components such as relays and the like which comprise portions of the starting, ignition or other systems.

A cooling system is provided for cooling one or more parts of the engine 26. The cooling system includes means for delivering coolant to the engine 26. Referring to FIG. 2, this means preferably comprises a coolant pump 150. The coolant pump 150 is positioned in the drive shaft housing 28 and driven by the drive shaft 58.

The coolant pump 150 draws water from the body of water in which the motor 20 is operating through an inlet 152 in the lower case 32 of the drive shaft housing 28. This coolant is delivered upwardly through the drive shaft housing 28 to the engine 26 through a coolant delivery line 156.

The coolant is delivered through one or more coolant passages or jackets, such as passages in the cylinder head 46 and block 48 and the passage 158 arranged to cool a portion of the exhaust system, for cooling various parts of the engine 26. The coolant preferably drains through a drain line from the engine 26 into a coolant pool 162 located in the drive shaft housing 28. The coolant pool 162 is preferably positioned adjacent the oil pan 144 and separated from the second expansion chamber 111 by a dividing wall 164.

The coolant drains from the pool 162 (such as over an overflow weir, not shown) through a drain passage 166 to a discharge through the drive shaft housing 28 back to the body of water in which the motor 20 is operating.

The cooling system may be provided with one or more thermostats (not shown) as known to those of skill in the art for use in controlling the flow of coolant through the engine 26. For example, a thermostat may be provided for limiting the flow of coolant through the engine 26 when the engine temperature is low, permitting the engine 26 to warm up.

The cooling system may also include a pressure relief valve (not shown) for diverting coolant from the cooling system in the event the pressure in the system exceeds a predetermined high pressure.

Referring to FIGS. 3 and 5, the engine 26 includes a crankcase pressure relief system. This system includes a crankcase breather element 170 which is connected to the crankcase cover 56. The element 170 has a passage therethrough which is in communication with the crankcase chamber and a by-pass or breather line 172 leading to the intake system.

During the operation of the engine 26, the fuel and air charge is input into the combustion chamber in a known manner. Next, the fuel and air mixture is compressed by the reciprocation of the piston 50 to a top dead center position. Once at the top dead center position the mixture is ignited. Because the piston seals do not completely seal to the cylinder wall a portion of the fuel and air mixture blows-by the piston 50 and enters the chamber 218 in which the crankshaft 52 reciprocates. Likewise, the seal between the valves 81,85 and the valve seat also allow a portion of the fuel and air mixture to enter the chamber 200 surrounding the camshaft 82. When the fuel and air mixture is in the chambers 200,218 a certain portion will combine with the engine oil that is also located in the chamber to lubricate the camshaft 82 and the crankshaft 52 respectively.

Figure 8:
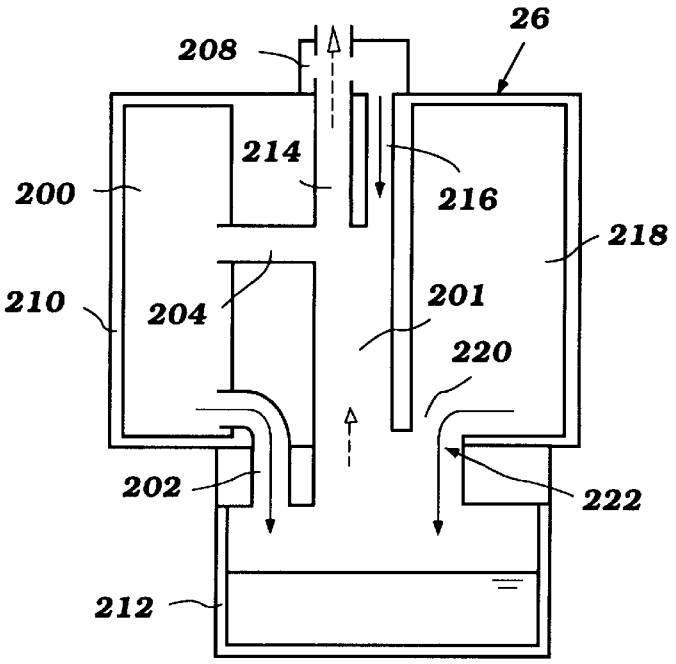
FIG. 8 is a schematic of the engine of FIG. 1 showing the flow path of the blow-by gas to the breather element.

FIG. 8 illustrates the flow path of the blow-by gas of the current invention. In this figure the camshaft chamber 200 includes an oil return passage located at the bottom thereof. The camshaft chamber 200 also includes a blow-by gas passage 204. The blow-by gas passage 204 is located roughly one half of the way up the internal walls of the camshaft chamber 200. Preferably, the passage 204 is located closer to the top of camshaft chamber 200.

Still referring to FIG. 8, the passage 204 is in fluid communication with the passage 206 which is in turn in fluid communication with the breather chamber 208. Preferably, the passage 204 is perpendicular to the blow-by passage 206. By arranging the passages 204,206 perpendicular to each other any engine oil combined with the blow-by gas will be separated. Further, the majority of the engine oil in the camshaft chamber 200 will be flung off of the spinning camshaft 82 in the away from the passage 204 thereby minimizing the possibilities of engine oil entering into passage 204. Rather, the engine oil will mostly travel down the wall 210 of the camshaft chamber 200 through the oil return passage 202 and into the oil pan 212.

Preferably, this arrangement of the camshaft chamber 200 will decrease the amount of engine oil into the passage 204 into to passage 206 and finally through the passage 214 to the breather element 208. In the event that engine oil does reach the breather element 208 it can travel through engine oil return 216 back down to the collection pan 212 as will be more fully described below.

Likewise, the crankshaft chamber 218 is also arranged in a manner to prevent engine oil from entering the breather element 208. As seen in FIG. 8, the crankcase chamber 218 has an opening 220 at the bottom thereof The opening 220 is located in the bottom of the chamber 218 in order to minimize the amount of engine oil entering the chamber 206. The crankshaft 52 rotates about a substantially vertical axis and flings the lubricating engine oil against the internal walls of chamber 218. In the configuration shown in FIG. 8 the engine oil will travel down the internal wall then through passage 222 and then into the oil collection pan 212 where it can then be recirculated into the lubrication galleries.

The blow-by gas in the crankcase chamber must likewise travel through the opening 220 and in a generally downward direction toward the oil in the oil collection pan 212. Next, the blow-by gas completely reverses direction and travels generally upwards into passage 206. Next, the blow-by gas travels into passage 214 and into the breather element. Preferably, the complete 180 degree change in the direction of the flow of the blow-by gas from when it exits the crankcase chamber 218 to when it is traveling generally upwards towards the breather element 208 will allow a majority of the engine oil to collect in the collection pan 212.

The configuration of the flow of the blow-by gas in the engine 26 is shown in FIGS. 9, 10, 11 and 12. FIG. 10 is a cross section of FIG. 9 taken generally along the line 10—10. This figure illustrates the relative orientations of the passages. For instance, the passage 204 is preferably substantially horizontal and parallel to the axis of the cylinder 49. Further, the cross sectional area for the passages is different. For example the cross sectional area of passage 206 is much greater than the passage 204. By having the passage be larger the pressure in the passage will be lower and the flow of blow-by gas will be low as well. By keeping the pressure low and the flow rate low in the area surrounding the oil collection area 212 the amount of engine oil that will be drawn from the oil collection area to into the passage 214 will be reduced.

Figure 12:
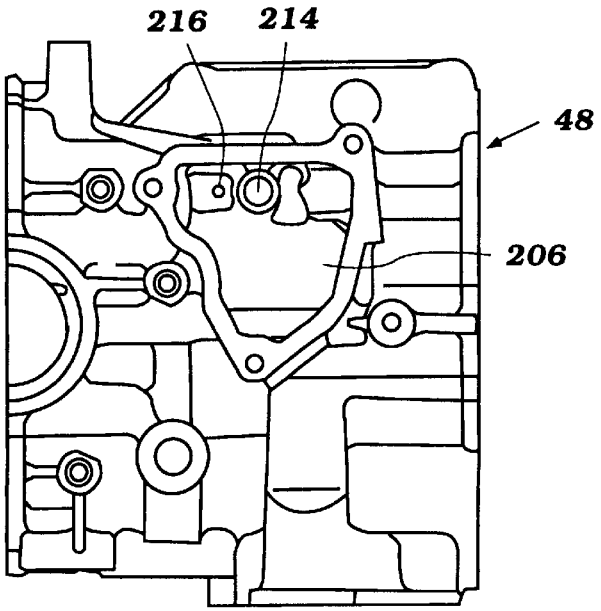
FIG. 12 is a partial top elevational view of the cylinder block of the engine of FIG. 1.

As is best illustrated in FIGS. 10 and 12, the relative size of the passages 206,214 is shown. More specifically, the cross sectional area of passage 206 is preferably much greater than that of passage 214. As described above this will prevent the ingress of engine oil into the breather element 208.

Further, the direction of the passages is 206,214 is also shown as being substantially vertical and parallel to the axis of rotation for crankshaft 52. By locating the passages 206,214 in a substantially vertical fashion gravity helps prevent the flow of engine oil into the breather element 208 which is located substantially on top of the engine 26.

Figure 9:
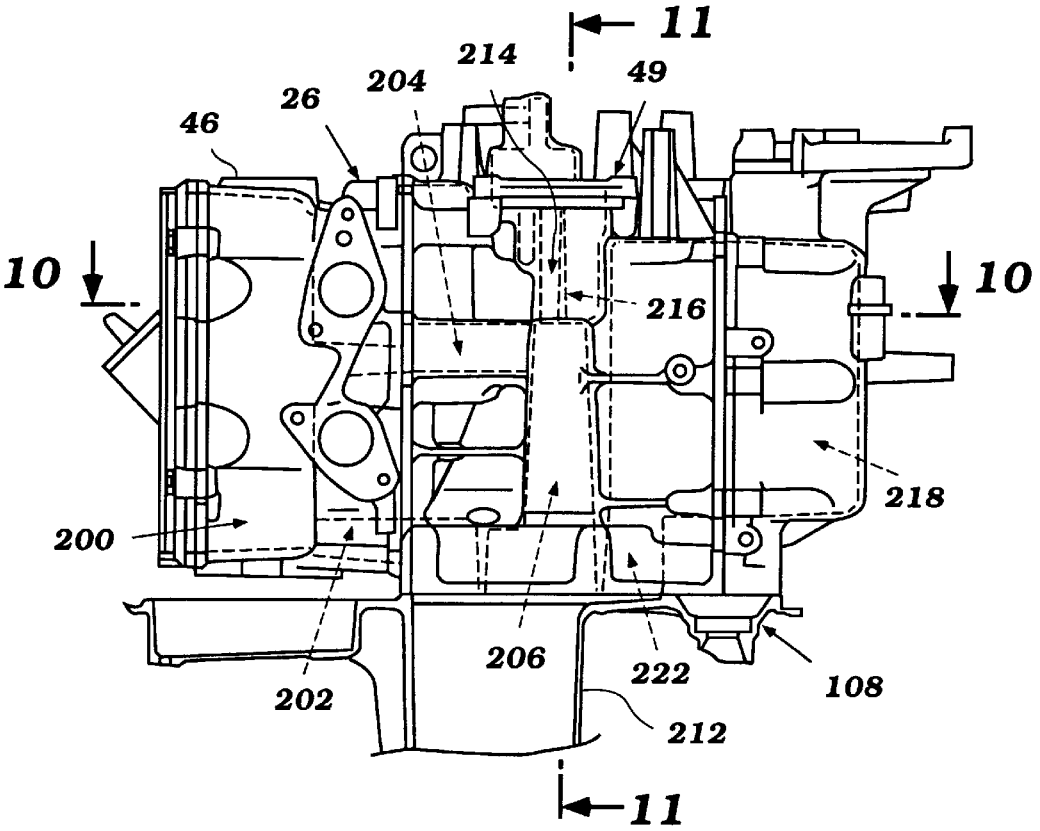
FIG. 9 is a side elevational view of a portion of the engine of FIG. 1 illustrating the orientation of the components of the flow path of the blow-by gas.
Figure 11:
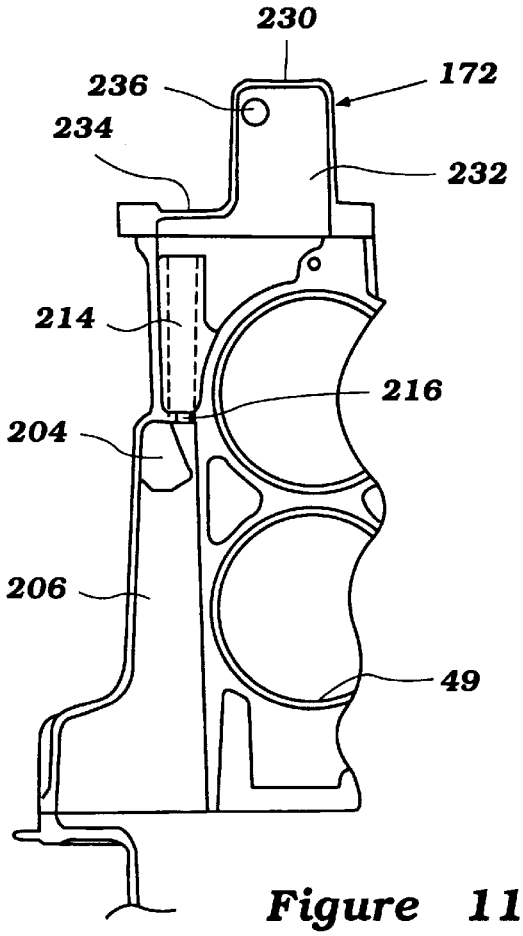
FIG. 11 is an enlarged partial cross-sectional view of the cylinder block of as shown in FIG. 9 taken generally along the line 11—11.

FIG. 11 is a cross section of FIG. 9 taken generally along the line 11—11. FIG. 11 also illustrates the design of the breather mechanism 208. Breather mechanism 208 includes an outer shell 230 which defines an inner chamber 232. The blow-by gas enters the chamber 208 through passage 214. Upon entering the chamber 232, the flow is directed off of the wall 234 which is preferably perpendicular to the flow path of the blow-by gas exiting passage 214. By directing the gas into the wall 234 any engine oil traveling with the blow-by gas will strike the wall and preferably drain back towards the oil collection pan 212 through passage 216.

Preferably, the outlet 236 for the breather 208 is perpendicular to side wall of the breather to prevent the engine oil from entering into the outlet 236 as best seen in FIG. 11.

Figure 13:
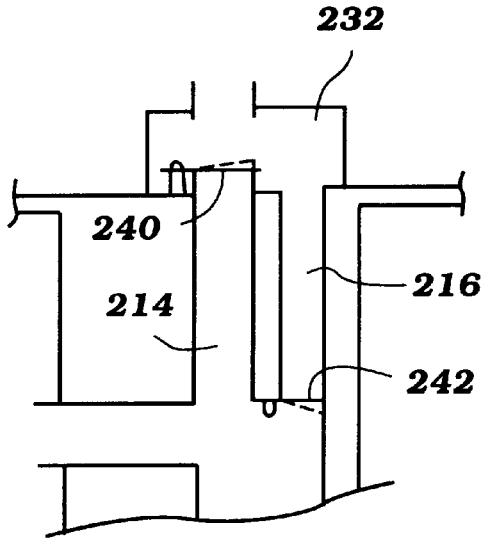
FIG. 13 is an enlarged portion of blow-by gas arrangement of the engine of FIG. 1.

FIG. 13 illustrates an embodiment of the invention incorporating a stopper valves between the breather chamber 232 and the passage 206. In this embodiment the engine oil is even further impeded from entering the breather chamber 232 by the incorporation of one-way valves. In this embodiment the blow-by gas will flow through passage 214 through one-way valve 240 and into the chamber 232. The location of the valve 240 preferably directs any engine oil in the chamber 232 into oil return 216. Engine oil will drain down passage 216 through one-way valve 242 back into collection pan 212. Valve 242 will also prevent blow by gas from entering passage 216 and thereby forcing engine oil from draining to the collection pan 212.

Figure 14:
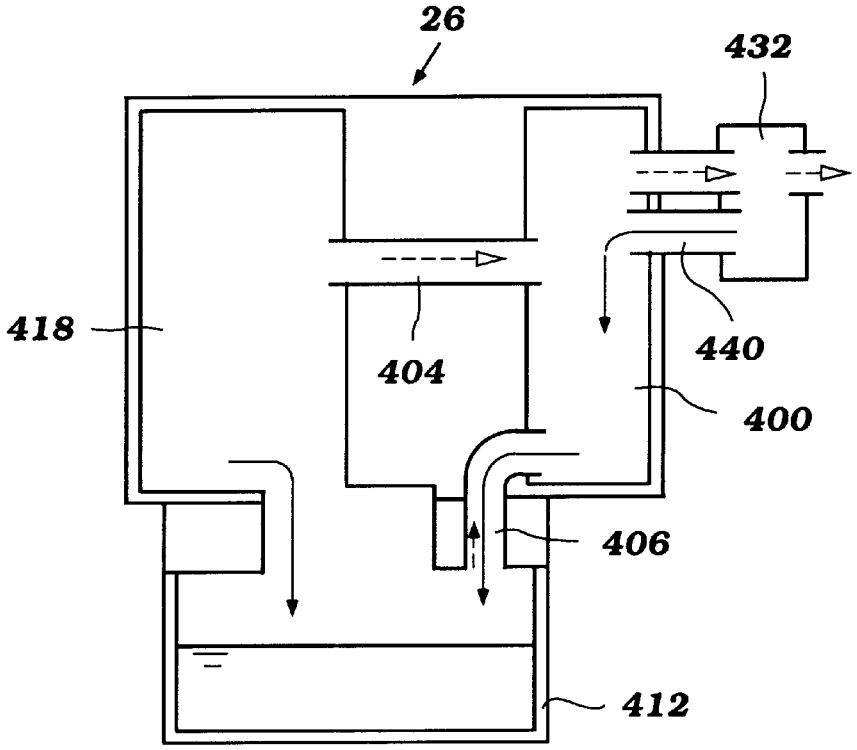
Figure 14 Prior Art
FIG. 14 is a schematic view of the blow-by gas arrangement of the prior art.

As discussed in the background, FIG. 14 illustrates the prior art solution. In this figure the crankcase chamber 418 opens toward the oil collection pan 412. The crankcase chamber 418 is also in fluid communication with blow-by gas passage 404. The blow-by gas can also exit the chamber 418 through passage 406. The passage 406 also acts as an oil return from the camshaft chamber 400. The flow of the blow by gas, however, is opposite the flow of engine oil thereby impeding the oil drainage from the chamber 400.

The flow problem is further exacerbated by the location of passage 404 and breather oil return 440. In this diagram, the oil return 440 is directly in line with passage 404 and therefore the return oil flow from the chamber 432 is impeded.

Of course, the foregoing description is that of preferred embodiments of the invention, and various changes and modifications may be made without departing from the spirit and scope of the invention, as defined by the appended claims.

What is claimed is:

1. An outboard motor having a cowling and a water propulsion device, an internal combustion engine positioned in said cowling and arranged to propel said water propulsion device, said engine including a top and a bottom side, said engine also including a cylinder block defining at least one horizontally extending cylinder bore therein, a crankshaft supported for rotation with respect to said engine block and driven by a piston reciprocating in said cylinder bore, said crankshaft being journalled in a crankcase chamber formed at one end of said cylinder block and closing one end of said cylinder bore, a cylinder head fixed relative to said cylinder block at the other end thereof and closing the other end of said cylinder bore, a camshaft supported for rotation by said cylinder head and contained within a camshaft chamber formed at least in part by said cylinder head, means for driving said camshaft from said crankshaft, a lubrication system for the lubrication of said crankshaft and said camshaft, a lubrication collection area located on said bottom side of said engine for the gravitational collection of engine lubrication fluid from respective drain passages formed at lower portions of said crankcase chamber and said camshaft chamber, a breather chamber located on said top side of said engine, said cylinder block forming a first, vertically extending passage providing fluid communication between an area above the lubricant in said lubrication collection area and said breather chamber and a second passage formed in said cylinder block and communicating said camshaft chamber and said first passage at a point vertically above said drain passages, said second passage being substantially perpendicular to said first passage.

2. An outboard motor of claim 1 wherein the upper end of said first passage communicates with said breather chamber through a third passage and a fourth passage for draining condensed oil from said breather chamber to said lubricant collection area, said fourth passage being substantially parallel to said third passage.

3. An outboard motor of claim 2 wherein said third passage has a greater cross-sectional area than said fourth passage.

4. An outboard motor of claim 3 further including a first one way valve located in said third passage allowing flow from said third passage to said breather chamber.

5. An outboard motor of claim 4 further including a second one way valve for controlling the flow through said forth passage for allowing flow from said breather chamber to said fourth passage.

6. An outboard motor of claim 1, wherein the breather chamber is formed in part by a recess in an upper surface of said cylinder block and is closed by a closure plate having a fitting for connection to an induction system for said engine for recirculating crankcase ventilating gases back to a combustion chamber of said engine.

7. An outboard motor of claim 6 wherein the upper end of said first passage communicates with said breather chamber through a third passage and a fourth passage for draining condensed oil from said breather chamber to said lubricant collection area, said fourth passage being substantially parallel to said third passage.

8. An outboard motor of claim 7 wherein said third passage has a greater cross-sectional area than said fourth passage.

9. An outboard motor of claim 8 further including a first one way valve located in said third passage allowing flow from said third passage to said breather chamber.

10. An outboard motor of claim 9 further including a second one way valve for controlling the flow through said forth passage for allowing flow from said breather chamber to said fourth passage.

* * * * *